US006776303B2

(12) United States Patent
Fripps

(10) Patent No.: US 6,776,303 B2
(45) Date of Patent: Aug. 17, 2004

(54) SELF-RIGHTING FLUID-STORAGE CONTAINER

(76) Inventor: Anthony Fripps, 1301 E. Mount Pleasant Ave., Philadelphia, PA (US) 19150-2009

( * ) Notice: Subject to any disclaimer, the term of this patent is extended or adjusted under 35 U.S.C. 154(b) by 55 days.

(21) Appl. No.: 10/274,323

(22) Filed: Oct. 18, 2002

(65) Prior Publication Data

US 2004/0074910 A1 Apr. 22, 2004

(51) Int. Cl.[7] ..... A47G 19/22
(52) U.S. Cl. ..... 220/603; 220/709; 220/710
(58) Field of Search ..... 270/603, 709, 270/710

(56) References Cited

U.S. PATENT DOCUMENTS

| | | | | |
|---|---|---|---|---|
| 434,423 A | * | 8/1890 | Burrows | 220/603 |
| 1,300,867 A | * | 4/1919 | Pick | 220/603 |
| 2,601,767 A | | 7/1952 | Wall | |
| 4,096,966 A | | 6/1978 | Korshak | |
| 4,303,170 A | | 12/1981 | Panicci | |
| 4,388,996 A | | 6/1983 | Panicci | |
| 4,953,737 A | | 9/1990 | Meyers | |
| 5,050,759 A | | 9/1991 | Marble | |
| 5,294,018 A | | 3/1994 | Boucher | |
| 5,295,598 A | | 3/1994 | Gerlach et al. | |
| 6,006,952 A | | 12/1999 | Lucas | |
| 6,168,034 B1 | | 1/2001 | Perrone | |

* cited by examiner

*Primary Examiner*—Joseph Man-Fu Moy
(74) *Attorney, Agent, or Firm*—Michael G. Crilly, Esq.

(57) ABSTRACT

The present invention is a fluid-storage container facilitating its efficient retrieval, use, and discard by an individual engaged in an athletic activity. The invention is comprised of a weighted base attached to a tube so that both are rotatably disposed effecting a self-righting movement about a preferred axis. In preferred embodiments, fluid is stored within a chamber along the tube. In alternate embodiments, fluid is stored within both tube and base. In yet other embodiments, the base is comprised of a rigid upper element attached to a lower deformable element capable of absorbing and dissipating impact energy. One or more optional hand grips are provided about the tube.

3 Claims, 5 Drawing Sheets

SELF-RIGHTING FLUID-STORAGE CONTAINER

CROSS REFERENCE TO RELATED APPLICATIONS

None.

FEDERALLY SPONSORED RESEARCH OR DEVELOPMENT

None.

BACKGROUND OF THE INVENTION

1. Field of the Invention

The present invention generally relates to a container for sports activities. Specifically, the invention is a weighted, fluid-storage container preferring a specific orientation when resting on a surface. Exemplary applications include a hand-held sports bottle and a ground mounted watering station.

2. Background

Access to and consumption of fluids are important considerations during an athletic competition. Fluid filled containers are commonly used during athletic events to facilitate hydration so to maintain energy and performance levels of a participant. The time required to retrieve, drink from, and thereafter discard a fluid filled container must be minimized so to maximize the competitive advantage of a participant.

Conventional container designs burden the athlete and frustrate the desired efficiencies. An athlete must retrieve and discard a container in a manner consistent with its design. Furthermore, the consumption of a fluid from a container often requires an athlete to operate a valve-like element.

Sports containers are typically cylinder shaped with a flat bottom. Preferred placement is achieved by resting the flat bottom on a horizontal surface. Lucas, U.S. Pat. No. 6,006,952 issued Dec. 29, 1999, is a specific illustration of a sports bottle having a flat bottom. A value-like cap facilitates fluid consumption and prevents spillage when preferred placement is not achieved.

Container designs similar to Lucas require a conscious effort on the part of the athlete to effect proper usage. In particular, the athlete must insure the container rests in a preferred orientation to avoid spillage and/or to achieve its retrieval for subsequent usage. Consequently, container designs within the related arts preclude discard via dropping or throwing rather preferring a controlled release.

What is required is a fluid container facilitating its efficient retrieval and discard during an athletic activity. What is required is a container that is self-righting when dropped or thrown. What is required is a container that is sufficiently robust so to resist damage when dropped or thrown. What is required is a container that prevents fluid spillage during retrieval and discard.

SUMMARY OF THE INVENTION

An object of the present invention is to provide a container facilitating its efficient retrieval and discard during an athletic activity.

Another object of the present invention is to provide a device that is self-righting when dropped or thrown.

Another object of the present invention is to provide a device that is sufficiently robust so to resist damage when dropped or thrown.

A further object of the present invention is to provide a container that prevents spillage when retrieved or discarded.

The present invention is comprised of a disk-shaped weighted base having one end of a tube fixed to the base in a perpendicular or nearly perpendicular arrangement. Mass properties of tube and base insure self-righting movement about a preferred axis.

The weighted base is composed of an impact resistant material, preferably a dense plastic. In preferred embodiments, the base is composed of a rigid homogenous mass. In alternate embodiments, the base is comprised of a rigid upper element fixed to a deformable lower element. An exemplary lower element is a flexible sack filled with a particulate. In yet other embodiments, an outer shell is filled with a dense ballast material.

The tube is composed of a rigid, impact resistant material, preferably a low-density plastic. A variety of tube shapes are possible. For example, the tube may have a uniform-diameter, cylindrical profile or a tapered profile having a smaller diameter at one end and a larger diameter where tube attaches to base.

Several fluid storage options are provided by the present invention. In preferred embodiments, a fluid storage chamber is contained within the tube. In yet other embodiments, additional fluid storage is provided within a chamber housed within the rigid base component. Fluid storage within the base further enhances the self-righting capability of the invention.

In preferred embodiments, a fluid stop, a first cap, and a straw are desired. A washer-shaped fluid stop is provided within the tube to restrict movement of fluid within the tube thereby insuring the desired self-righting motion. A cup-shaped first cap is attached at the tube end opposite from the base attachment. A first cap is secured in a fashion that allows its removal from the tube. A straw is slidably disposed within a hole provided through fluid stop and first cap.

Alternate embodiments include several optional elements. A cup-shaped second cap is secured to the straw end extending from the container. One or more hand grips are either fixed to or slidably disposed along the exterior surface of the tube. Preferred grip materials include low-density, compressible foams.

Two advantages are offered by the present invention. The invention simplifies discard of a fluid filled container during a sports activity by insuring an orientation optimally suited to retrieval. The invention prevents fluid spillage via a self-righting motion thereby avoiding fluid flow towards the open end of the container.

BRIEF DESCRIPTION OF THE DRAWINGS

The invention will now be described in more detail by way of example only, with reference to the accompanying drawings, in which.

REFERENCE NUMERALS

Figure 1:
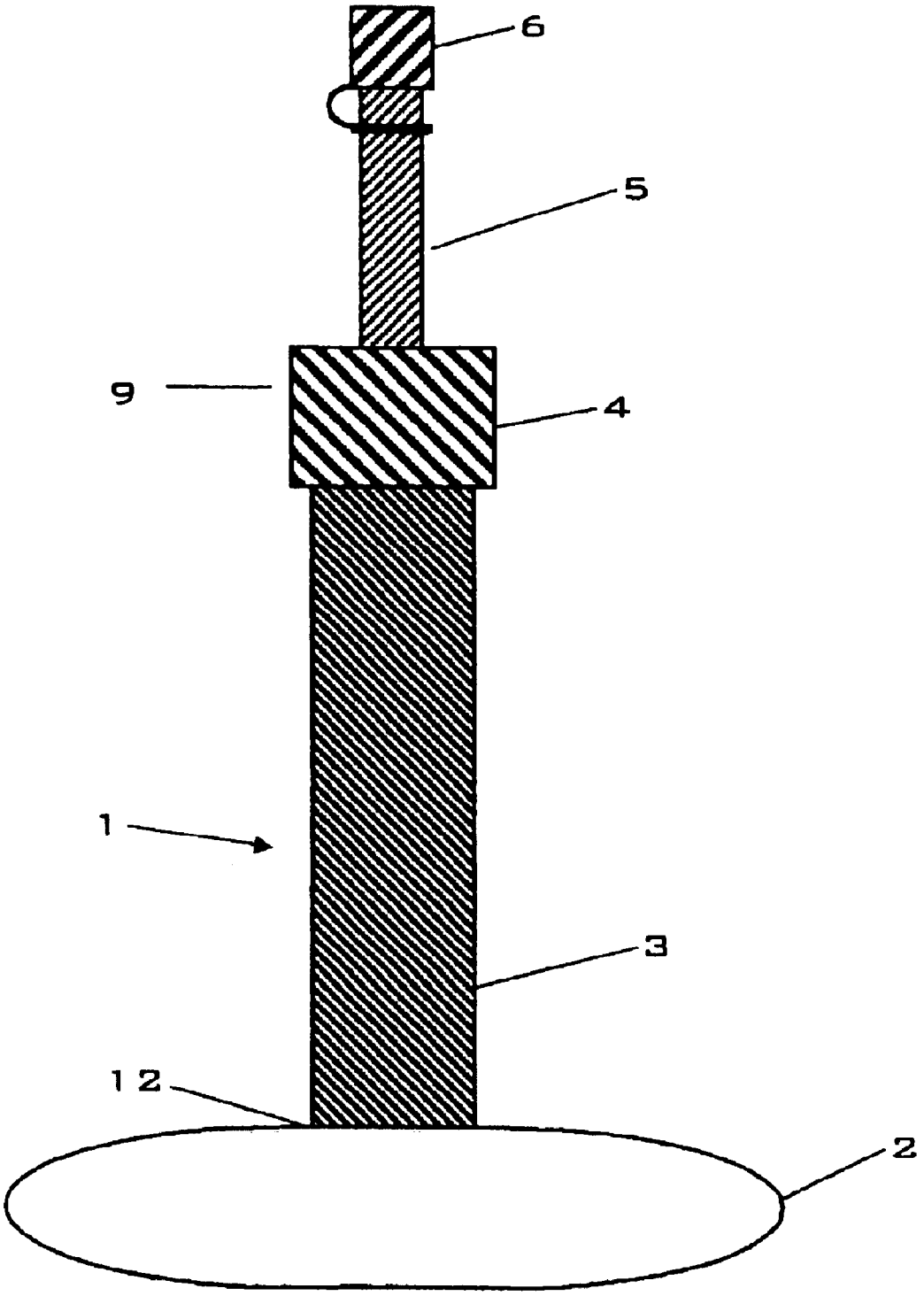
FIG. 1 is a side elevation view of self-righting container.

1 Container
2 Weighted base
3 Tube
4 First cap
5 Straw
6 Second cap
7 Storage chamber
8 Fluid stop
9 First end
10 Ring
11 Tab
12 Second end
13 Cover
14 Shell
16 First storage chamber
17 Ballast
18 Rigid upper element
19 Deformable lower element
20 Surface
21 Preferred axis
22 Grip
23 Orifice
24 Opening
25 Exterior surface
26 Second storage chamber
27 Bulkhead
28 Top surface
29 Bottom surface
31 Interior surface
32 Straw end
33 Interface
34 Finger groove

DESCRIPTION OF THE INVENTION

The present invention relates to a container 1 for storing and dispensing fluid during an athletic event. FIGS. 1 through 8 describe the present invention and variants thereof Drawings are not to scale.

FIG. 1 shows a side elevation view of one embodiment of the present invention referred to hereafter as a container 1. The container 1 is comprised of a weighted base 2 attached to a second end 12 of a tube 3 and having a first cap 4 removably attached at a first end 9 of the same tube 3. A straw 5 is fixed or slidably disposed with respect to the first cap 4. A second cap 6 is attached yet detachable from the straw 5.

Figure 2:
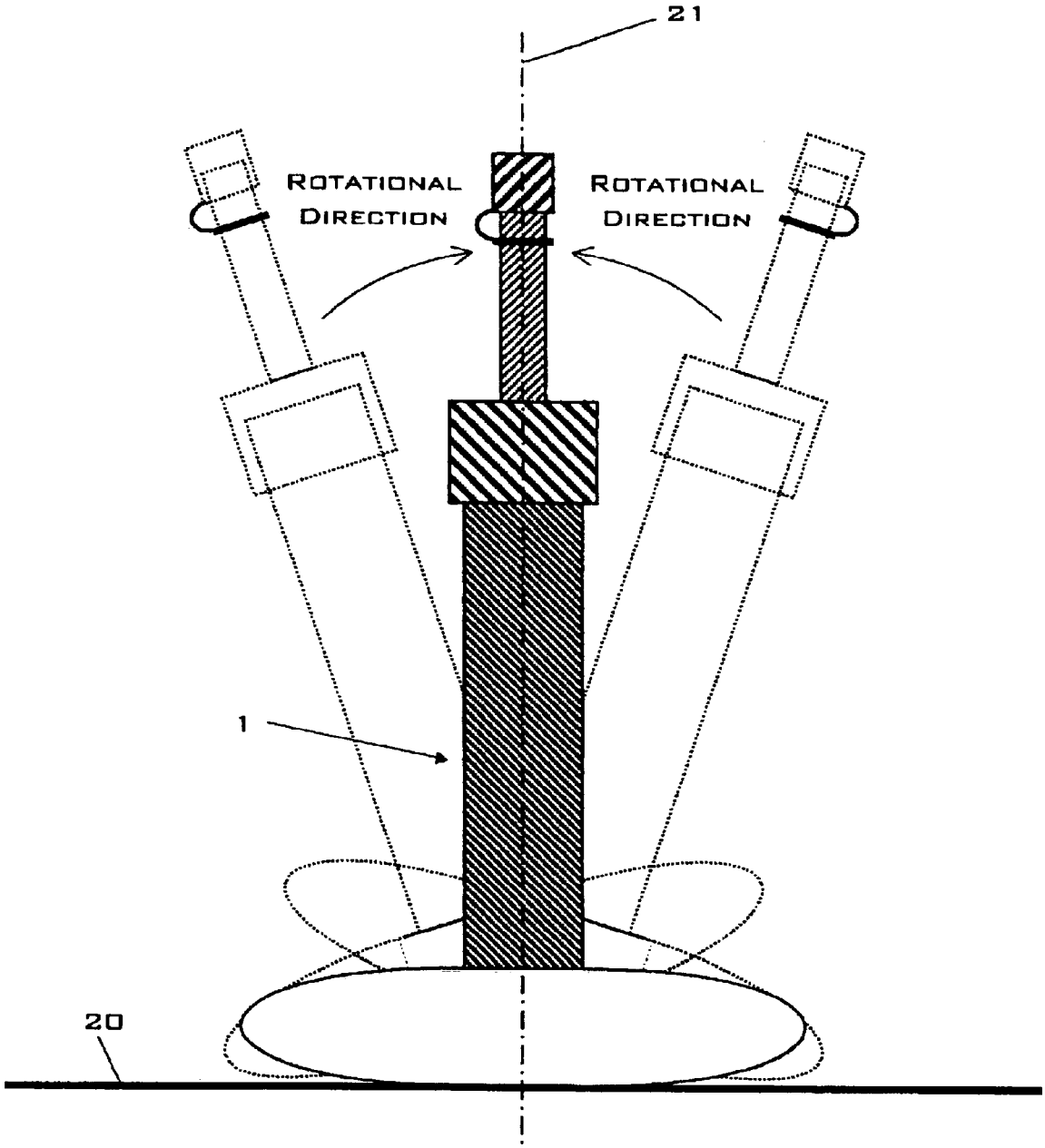
FIG. 2 is a schematic diagram showing self-righting motion of container about a preferred axis.

Referring now to FIG. 2, a container 1 is shown in a preferred vertical orientation with respect to a surface 20. The container 1 has a center of mass insuring orientation about the preferred axis 21. The preferred axis 21 may be perpendicular to or nearly perpendicular to the surface 20. Movement of the container 1 away from the preferred axis 21 causes a self-righting motion towards the preferred axis 21.

Figure 3:
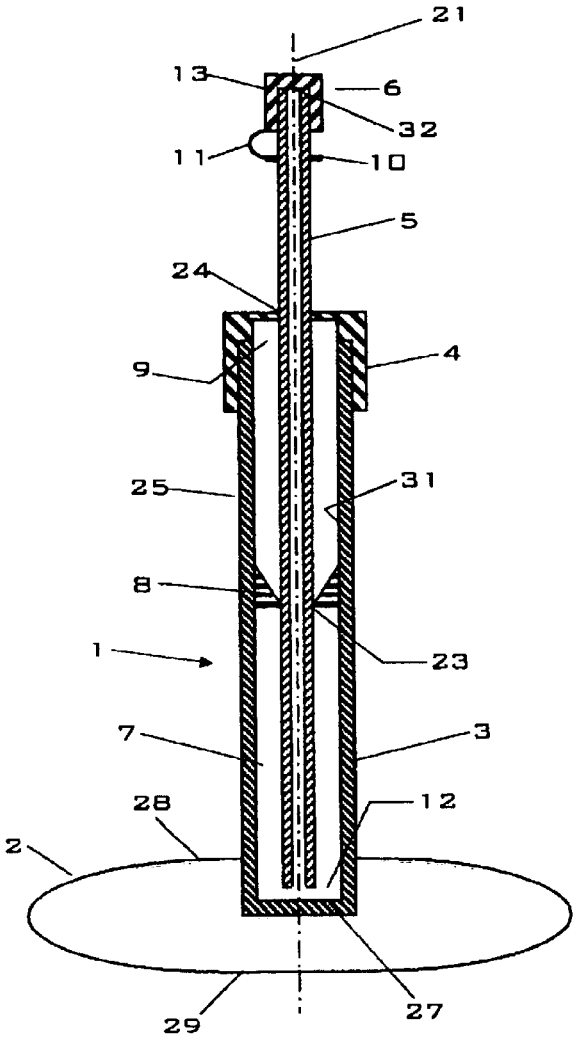
FIG. 3 is a section view of container wherein fluid is stored within a tube.

FIG. 3 shows a cross section of a preferred embodiment of the container 1 wherein fluid is stored within a tube 3 attached to a weighted base 2. The weighted base 2 is composed of a solid, circular-shaped element having a cross section symmetrically disposed about the preferred axis 21. The bottom surface 29 of the weighted base 2 is contoured so to allow rotation of the container 1 towards the preferred axis 21. A self-righting elliptical cross section is shown in FIG. 3, however other self-righting shapes known within the art are applicable to the present invention.

Again referring to FIG. 3, the tube 3 is composed of a cylinder-shaped element of smaller diameter than the weighted base 2 and having a first end 9 and a second end 12. Tube 3 shapes include right-circular and tapered cylinders, as well as variants of the before mentioned having a textured exterior surface 25 to improve grip characteristics. The first end 9 of the container 1 is open whereas the second end 12 is closed via a bulkhead 27 attached to or molded onto the second end 12. The diameter and length of the tube 3 determine fluid storage capacity. The tube 3 may be composed of an impact resistant material, preferably a low-density plastic examples including but not limited to polyethylene and polypropylene.

The tube 3 is attached to the weighted base 2 preferably within a recessed cavity of comparable shape along the top surface 28 of the weighted base 2, as shown in FIG. 3. While various attachment methods are possible, the tube 3 may be adhesively bonded to the weighted base 2 or mechanically fastened via threads along mutually contacting surfaces between tube 3 and weighted base 2. Alternatively, weighted base 2 and tube 3 may be molded to form a single unit when composed of plastic or other formable material.

The center of mass of tube 3 and weighted base 2 with and without fluid should be sufficiently positioned to insure self-righting movement of the container 1 about the preferred axis 21. In preferred embodiments, the center of mass is positioned along the preferred axis 21 adjacent to the top surface 28 or within the cross section of the weighted base 2. The weighted base 2 may be composed of an impact resistant material, preferably a dense plastic. In preferred embodiments, the weighted base 2 is composed of a rigid homogenous mass.

A fluid stop 8 comprised of a washer-shaped element is disposed along the interior surface 31 of the tube 3. Referring again to FIG. 3, the fluid stop 8 is positioned along the tube 3 so to restrict fluid movement within a storage chamber 7 formed by tube 3 between fluid stop 8 and second end 12. The fluid stop 8 may be slidably disposed along or mechanically fastened to or adhesively bonded to the interior surface 31 at a predetermined depth. A slidably disposed fluid stop 8 facilitates adjustment to the fluid column within the tube 3 to tailor the mass properties of a fluid filled container 1 to achieve the desired self-righting movement. The fluid stop 8 may be composed of an impact resistant material; preferably a low-density plastic examples including but not limited to polyethylene and polypropylene.

A first cap 4 comprised of a cup-shaped element is removably attached to the first end 9 of the tube 3. Attachment is achieved via an interference fit between first cap 4 and tube 3 or via a thread arrangement along mutually contacting surfaces between first cap 4 and tube 3. The first cap 4 may be composed of an impact resistant material, preferably a low-density plastic examples including but not limited to polyethylene and polypropylene.

A straw 5 comprised of a tube-shaped element is slidably disposed within an opening 24 along the first cap 4 and an orifice 23 along the fluid stop 8. The straw 5 is positioned within the container 1 so to facilitate fluid consumption from the storage chamber 7. Limited gas flow is provided between straw 5 and orifice 23 and opening 24 to prevent the formation of a vacuum as fluid is removed from the container 1. The straw 2 may be composed of an impact resistant material, preferably a low-density plastic, examples including but not limited to polyethylene and polypropylene.

A second cap 6 is attached to and removably from the straw end 32 extending from the container 1. While various shapes and attachments are possible, a preferred second cap 6 is comprised of a washer-shaped ring 10 slidably disposed about the straw 5 having a tab 11 attached to a cup-shaped cover 13. The cover 13 fits snugly over the straw end 32. Both ring 10 and tab 11 insure continued attachment of cover 13 to straw 5 when cover 13 is removed from the straw end 32. The second cap 6 may be composed of an impact resistant material, preferably a low-density plastic examples including but not limited to polyethylene and polypropylene.

Figure 4:
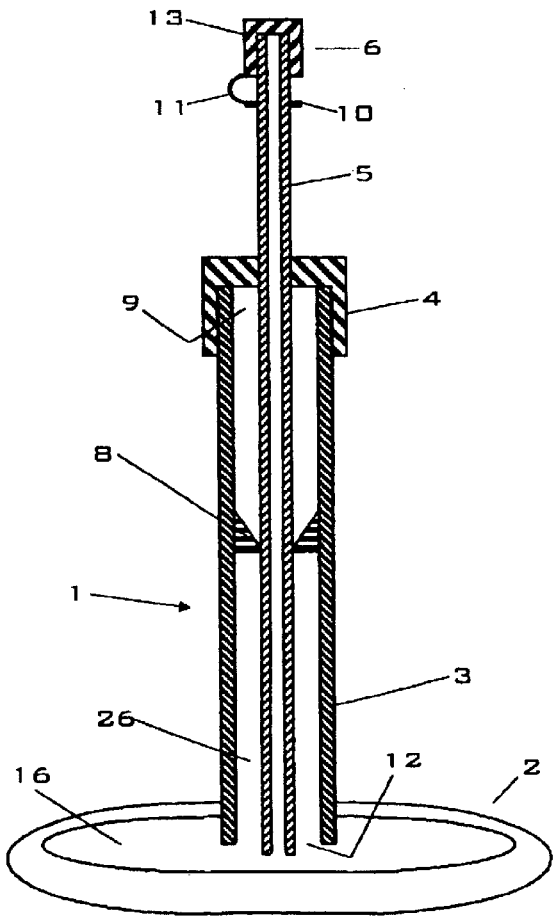
FIG. 4 is a section view of container showing an alternate embodiment wherein fluid is stored within both tube and weighted base.

FIG. 4 shows a cross section view of an alternate embodiment of the container 1 wherein fluid is stored within both tube 3 and weighted base 2. In this embodiment, the second end 12 of the tube 3 is open thereby communicating fluid within a second storage chamber 26 within the tube 3 into a first storage chamber 16 composed of a cavity within the weighted base 2. A straw 5 is slidably disposed through both first cap 4 and fluid stop 8 so to facilitate consumption of fluid from both first storage chamber 16 and second storage chamber 26. Limited gas flow is allowed between straw 5 and orifice 23 and opening 24 to prevent the formation of a vacuum as fluid is removed from the container 1.

Figure 5:
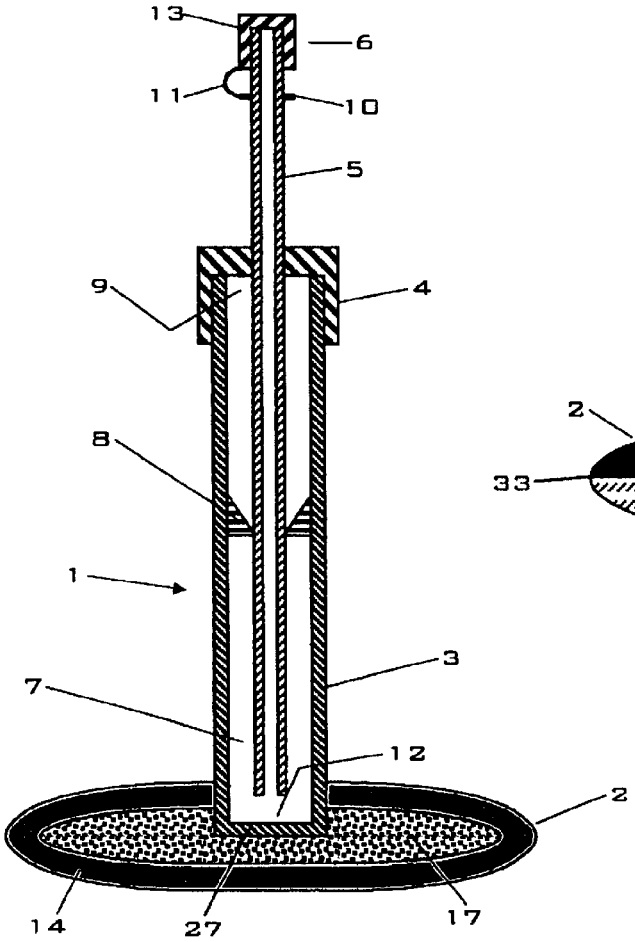
FIG. 5 is a section view of container showing an alternate embodiment having a ballast-filled base.
Figure 6:
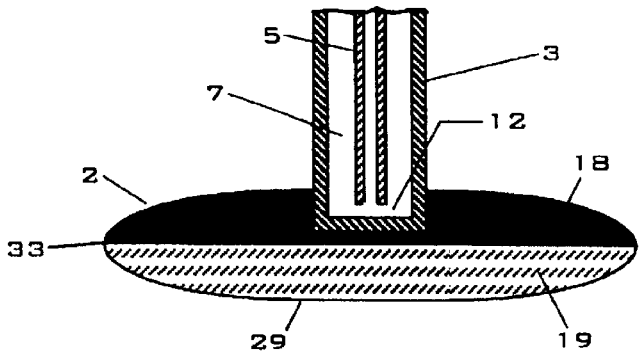
FIG. 6 is a section view showing weighted base composed of rigid upper element and deformable lower element with fluid storage within tube.
Figure 7:
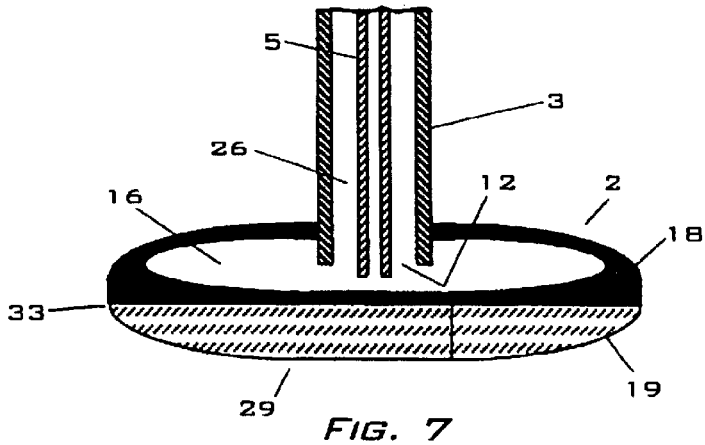
FIG. 7 is a section view showing weighted base composed of rigid upper element and deformable lower element with fluid storage within tube and weighted base.

FIGS. 5 through 7 show alternate embodiments of the weighted base 2. FIG. 5 describes a weighted base 2 composed of a shell 14 filled with ballast 17. The shell 14 may be composed of a flexible or rigid material including but not limited to impact resistant plastics. The ballast 17 is a dense particulate or homogenous mass, examples including but not limited to plastic, sand, or metal.

FIGS. 6 and 7 describe bi-layer embodiments of the weighted base 2. FIG. 6 shows a rigid upper element 18 fixed to a deformable lower element 19. FIG. 7 is a variant of FIG. 6 wherein the rigid upper element 18 has a cavity comprising a first storage chamber 16 communicating with a second storage chamber 26.The rigid upper element 18 is composed of an impact resistant plastic. The deformable lower element 19 is composed of a flexible sack-like membrane, examples including cloth or rubber, filled with a particulate mass, preferably a dense plastic, metal, sand or similar material. In both embodiments, the rigid upper element 18 and deformable lower element 19 are attached along a horizontally disposed interface 33. Attachment is provided via mechanical fasteners or adhesive layer between rigid upper element 18 and deformable lower element 19. The deformable lower element 19 absorbs and dissipates impact energy when container 1 is discarded. The bottom surface 29 of the weighted base 2 is contoured so to facilitate rotational motion of the container 1 towards the preferred axis 21.

Figure 8:
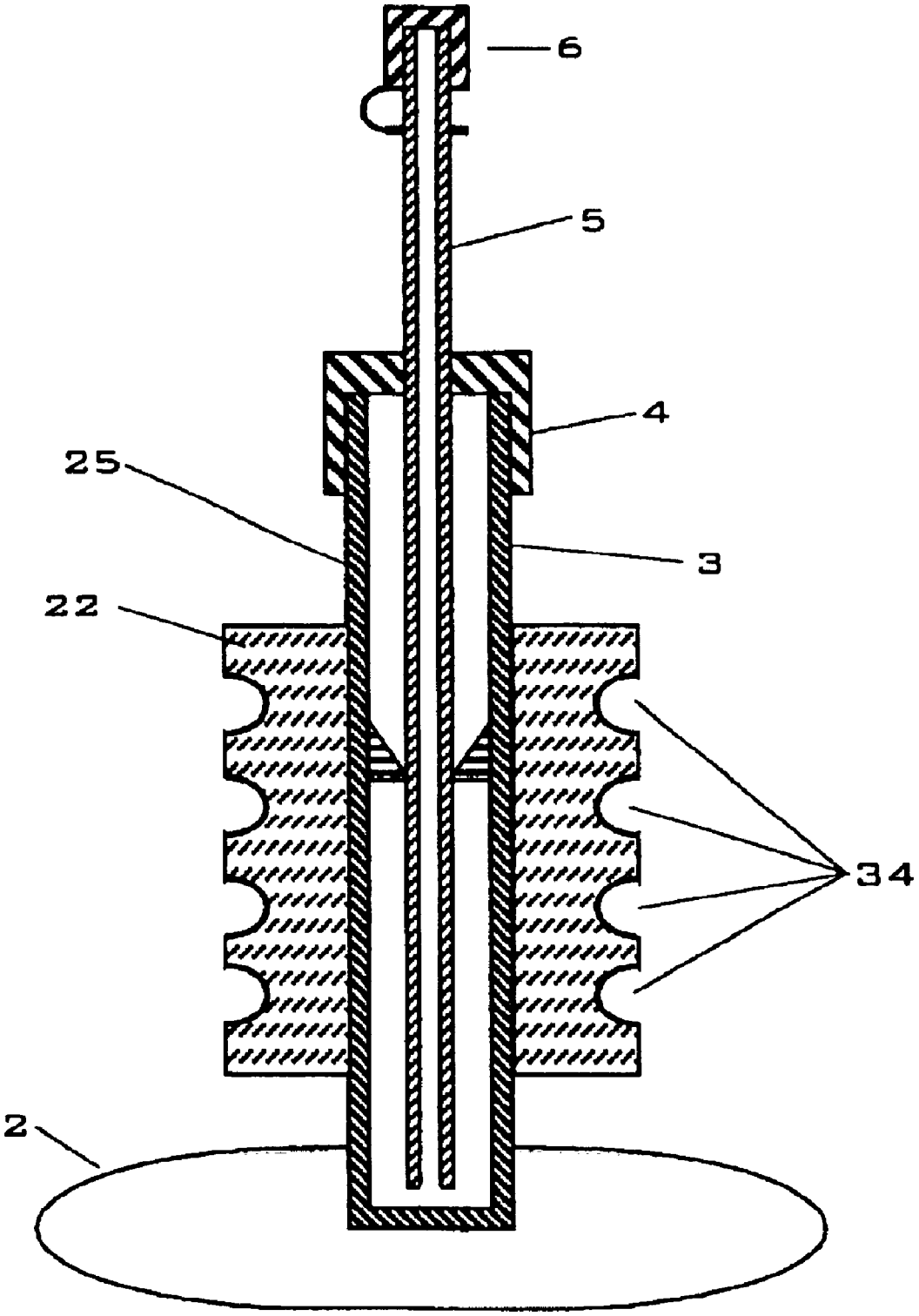
FIG. 8 is a section view showing hand grip disposed about tube.

In alternate embodiments, one or more grips 22 are provided along the exterior surface 25 of the tube 3. Referring now to FIG. 8, the container 1 is shown with a single tube-shaped grip 22 having horizontally disposed finger grooves 34 surrounding a tube 3. The grip 22 may be slidably disposed along the exterior surface 25 of the tube 3. In preferred embodiments, the grip 22 is adhesively bonded to tube 3 While various grip 22 materials are possible, preferred embodiments are composed of a low-density compressible material, one example being foam.

The description above indicates that a great degree of flexibility is offered in terms of the container 1. Although the present invention has been described in considerable detail with reference to certain preferred versions thereof, other versions are possible. Therefore, the spirit and scope of the appended claims should not be limited to the description of the preferred versions contained herein.

What is claimed is:

1. A container capable of self-righting movement about a preferred axis comprising:

(a) a weighted base; and (b) a tube having a storage chamber between a first end and a second end, said first end allowing a fluid to pass into and out of said tube, said second end fixed to said weighted base, said tube having a diameter less than said weighted base, said tube and said weighted base disposed and rotatable about said preferred axis;

(c) a fluid stop disposed said tube, said fluid stop having an orifice so to allow said fluid to pass into and out of said storage chamber;

(d) a first cap having an opening, said first cap removably attached to said first end; and (e) a straw slidably disposed within said orifice and said opening, said straw facilitating passage of said fluid from said storage chamber.

2. The container of claim 1, further comprising:

(f) an end cap removably attached to said straw.

3. The container of claim 2, further comprising:

(g) at least one hand grip disposed around said tube.

* * * * *

UNITED STATES PATENT AND TRADEMARK OFFICE

CERTIFICATE OF CORRECTION

PATENT NO. : 6,776,303 B2
DATED : August 17, 2004
INVENTOR(S) : Fripps

It is certified that error appears in the above-identified patent and that said Letters Patent is hereby corrected as shown below:

Column 6,
Line 14, insert -- . -- after "3"
Line 27, delete "and"
Line 35, insert -- within -- after "disposed"

Signed and Sealed this

Fourteenth Day of December, 2004

JON W. DUDAS
*Director of the United States Patent and Trademark Office*